US006924006B2

(12) United States Patent
Ruschak

(10) Patent No.: US 6,924,006 B2
(45) Date of Patent: Aug. 2, 2005

(54) LIP PREPARATION APPARATUS AND METHOD FOR IMPROVING THE UNIFORMITY OF A LIQUID CURTAIN IN A CURTAIN COATING SYSTEM

(75) Inventor: Kenneth J. Ruschak, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/286,031

(22) Filed: Nov. 1, 2002

(65) Prior Publication Data

US 2004/0086653 A1 May 6, 2004

(51) Int. Cl.[7] ..... B05D 1/30; B05C 5/00

(52) U.S. Cl. ..... 427/444; 427/420; 118/323; 118/324; 118/DIG. 4

(58) Field of Search ..... 118/323, 324, 118/DIG. 4; 427/420, 444

(56) References Cited

U.S. PATENT DOCUMENTS

| | | | | |
|---|---|---|---|---|
| 3,508,947 A | | 4/1970 | Hughes | |
| 5,328,726 A | | 7/1994 | Reiter | |
| 5,338,359 A | | 8/1994 | Conroy et al. | |
| 5,462,598 A | | 10/1995 | Servant et al. | |
| 5,725,666 A | | 3/1998 | Baumlin | |
| 5,763,013 A | | 6/1998 | Devine et al. | |
| 5,976,251 A | | 11/1999 | Devine, III et al. | |
| 6,294,023 B1 | * | 9/2001 | Katagiri et al. | 118/410 |
| 6,346,299 B1 | | 2/2002 | Gruszczynski, II et al. | |
| 6,387,455 B1 | * | 5/2002 | Katagiri et al. | 427/420 |

FOREIGN PATENT DOCUMENTS

| | | | |
|---|---|---|---|
| JP | 63-051973 | * | 3/1988 |

* cited by examiner

*Primary Examiner*—Katherine Bareford
(74) *Attorney, Agent, or Firm*—Susan L. Parulski

(57) ABSTRACT

An apparatus and method for improving the uniformity of a liquid curtain in a coating system comprising a lip of a slide die wherein the lip includes a front surface on which a liquid composition flows by gravity. The apparatus comprises a ledge having a first, second, and third surface portion. The first surface portion is disposed intermediate the second and third surface portions, and is substantially horizontal. The second surface portion is contiguous with the first surface portion and upwardly inclined. The third surface portion is contiguous with the first surface portion and downwardly inclined away from the first and second surface portions. The apparatus further includes a positioning device for positioning the ledge and lip relative to each other (1) in a first orientation wherein the lip is disposed proximate the first surface portion whereby the liquid composition flows from the slide die onto the first surface portion, and (2) in a second orientation wherein the lip and the ledge are spaced from each other whereby the liquid composition forms a vertical liquid curtain in free fall.

23 Claims, 10 Drawing Sheets

LIP PREPARATION APPARATUS AND METHOD FOR IMPROVING THE UNIFORMITY OF A LIQUID CURTAIN IN A CURTAIN COATING SYSTEM

FIELD OF THE INVENTION

The present invention relates generally to a method and apparatus for coating objects, such as a moving web, by curtain coating. More particularly, the invention relates to an improved curtain coating method and apparatus for the manufacture of sheet goods, including film and paper.

BACKGROUND OF THE INVENTION

In curtain coating, a moving receiving surface is coated by the impingement of a free-falling curtain of liquid coating composition. The curtain may be a single coating composition or a composite of several layers of distinct coating compositions, such as described in U.S. Pat. No. 3,508,947 (Hughes), commonly assigned. The coating-receiving surface can be any surface that can be passed through a curtain. For example, the receiving surface can be the surface of a discrete object but is typically the surface of a continuous web of paper, plastic, metal, or cloth.

Various means are well known for forming a free falling liquid curtain. Dies or weirs may be used, for example. A curtain that is a composite of several layers of distinct coating compositions can be formed by a slide die with multiple elements for distributing coating compositions as layers and with an inclined slide surface on which the layers flow by gravity.

Referring to FIG. 1, there is shown generally a curtain coating system comprising two slots 2,3 from which two layers flow superimposed on an inclined flow surface 4. The system includes a lip area/region 5 from which the coating composition leaves the system along a front surface 6, forming a curtain. The curtain then impinges onto a surface, for example a moving support.

Generally, the coating composition falls from a horizontal lip to the coating-receiving surface over a vertical distance between about 2 cm and about 30 cm. The coating composition in the curtain is freely falling and accelerates by gravity.

It is known to employ various edge guide means for maintaining the width of the free falling curtain against surface tension. In some arrangements, each edge guide comprises parallel dual wires, flushing means near the lip of the slide die, and suction means near the coating-receiving surface, as disclosed in U.S. Pat. No. 5,328,726 (Reiter), U.S. Pat. No. 5,725,910 (Devine), U.S. Pat. No. 5,763,013 (Devine), or U.S. Pat. No. 5,976,251 (Devine), all commonly assigned.

There exists a wetting line on the lip where the curtain forms. For a slide die with multiple elements, a front surface of the lip is part of the slide surface over which the composite layer of coating composition flows. There is a wetting line on a partially wetted back surface of the lip. The front surface of the lip may be substantially vertical, and the back surface of the lip may form a sharp angle, such as 30°, with the front surface of the lip. The back surface of the lip is typically upwardly inclined to direct flow into the curtain. The tip of the lip may be sharp or chamfered. An example of a lip is disclosed in U.S. Pat. No. 5,462,598 (Servant), commonly assigned, wherein the wetting line is not positioned at the tip of the lip, but rather at some small distance, less than about 1 mm, along the back surface of the lip.

Ideally, the wetting line is straight and horizontal, but this is typically not the outcome of starting flow and forming a curtain. More likely, the position of the wetting line varies along the lip and may be jagged in some areas. It is known that an irregular wetting line can cause objectionable non-uniformities in the coated layers of highly sensitive products. These non-uniformities in the coated layers usually continue in the coating direction substantially unchanged and are typically referred to as "streaks". An irregular wetting line can also give rise to stationary waves in the curtain which can also result in streaks in the coated layers.

One known apparatus intended to improve/correct the shape of the wetting line is disclosed in U.S. Pat. No. 5,725,666 (Baumlin), commonly assigned, and is shown in FIG. 2. Baumlin teaches an apparatus for forcing the liquid composition which flows on the forward face of the lip to wet the rear face of the lip of the coating device over a predetermined distance greater than the distance over which the liquid composition would naturally wet the rear face. While this apparatus has achieved a certain degree of success, the apparatus directly contacts the lip.

Another known apparatus intended to correct wetting line shape is disclosed in U.S. Pat. No. 6,346,299 (Gruszczynski), commonly assigned, and is shown in FIG. 3. Gruszczynski employs a movable trough positioned in proximity to the lip. The coating composition flowing on the slide is intercepted by the trough and fills the trough. The level of coating composition wets the back surface of the lip beyond the natural position of the wetting line. The ends of the trough are preferably open to prevent or limit the overflowing of the edges of the trough. The movable trough is then extracted. This apparatus avoids contact with the lip, however, a translation or rotary motion of the trough is required.

When a coating composition is initially supplied to a curtain formation apparatus, splashing and contamination can result if the height of the lip is above the coating zone. A preparation pan with edge walls to minimize splashing and splattering is disclosed in U.S. Pat. No. 5,338,359 (Conroy), commonly assigned, and is shown in FIG. 4. The preparation pan includes flushed edge walls spaced from edge guides to stabilize partial curtains outside the preparation pan. While this apparatus has achieved a certain degree of success, the pan is intricate, and its use alone does not ensure a straight wetting line on the lip. Additional remedies are referenced in Baumlin or Gruszczynski.

Accordingly, there exists a need for an apparatus and method for generating a straight wetting line on the back surface of a lip of a slide die for curtain coating. It is preferred that the apparatus is stationary, does not require physical contact with the lip, and does not result in spillage, splashing, or contamination.

SUMMARY OF THE INVENTION

An object of the present invention is to provide a method and apparatus for generating a straight wetting line on the back surface of a lip of a slide die for curtain coating.

Another object of the present invention is to provide such an apparatus and method for wetting line formation that does not require physical contact with the lip.

A further object of the present invention is to provide such an apparatus and method for wetting line formation that can be stationary and can utilize the positioning mechanism for the slide die.

Yet a further object of the present invention to provide such an apparatus and method for wetting line formation that does not result in spillage, splashing and/or contamination.

A still further object of the present invention to provide such an apparatus and method for wetting line formation wherein the curtain is left in full contact with the edge guides.

Yet a still further object of the present invention to provide such an apparatus and method for wetting line formation that can additionally be employed in cleaning the lip.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

According to one aspect of the invention, there is provided an apparatus for improving the uniformity of a liquid curtain in a coating system comprising a lip of a slide die wherein the lip includes a front surface on which a liquid composition flows by gravity. The apparatus comprises a ledge and positioning means. The ledge includes a first, second, and third surface portion. The first surface portion is disposed intermediate the second and third surface portions. The first surface portion is substantially horizontal. The second surface portion is contiguous with the first surface portion and upwardly inclined. The third surface portion is contiguous with the first surface portion and downwardly inclined away from the first and second surface portions. The positioning means positions the ledge and lip relative to each other (1) in a first orientation wherein the lip is disposed proximate the first surface portion whereby the liquid composition flows from the slide die onto the first surface portion, and (2) in a second orientation wherein the lip and the ledge are spaced from each other whereby the liquid composition forms a vertical liquid curtain in free fall.

According to another aspect of the invention, there is provided a method for improving the uniformity of a liquid curtain in a coating system comprising a lip of a slide die wherein the lip includes a front surface on which a liquid composition flows by gravity. The method comprises the steps of: (1) providing a ledge having a first, second, and third surface portion wherein the first surface portion is disposed intermediate the second and third surface portions, the first surface portion is substantially horizontal, the second surface portion is contiguous with the first surface portion and upwardly inclined, and the third surface portion is contiguous with the first surface portion and downwardly inclined away from the first and second surface portions; (2) supplying the liquid composition to the slide die; and (3) positioning the ledge and lip relative to each other in a first orientation wherein the lip is disposed proximate the first surface portion whereby the liquid composition flows from the slide die onto the first surface portion.

BRIEF DESCRIPTION OF THE DRAWINGS

The foregoing and other objects, features, and advantages of the invention will be apparent from the following more particular description of the preferred embodiments of the invention, as illustrated in the accompanying drawings.

DETAILED DESCRIPTION OF THE INVENTION

Figure 1:
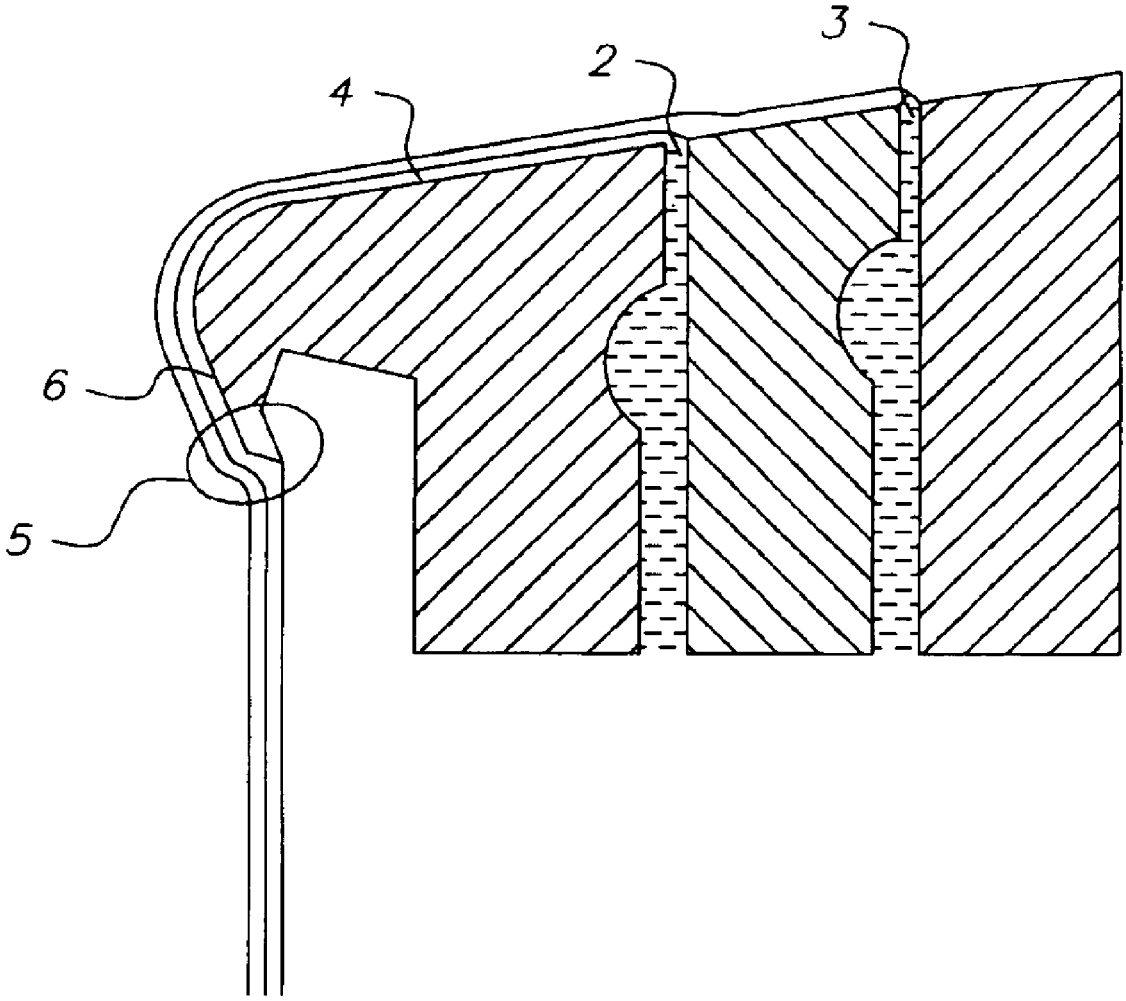
FIG. 1 (PRIOR ART)
FIG. 1 shows generally a prior art curtain formation system.
Figure 2:
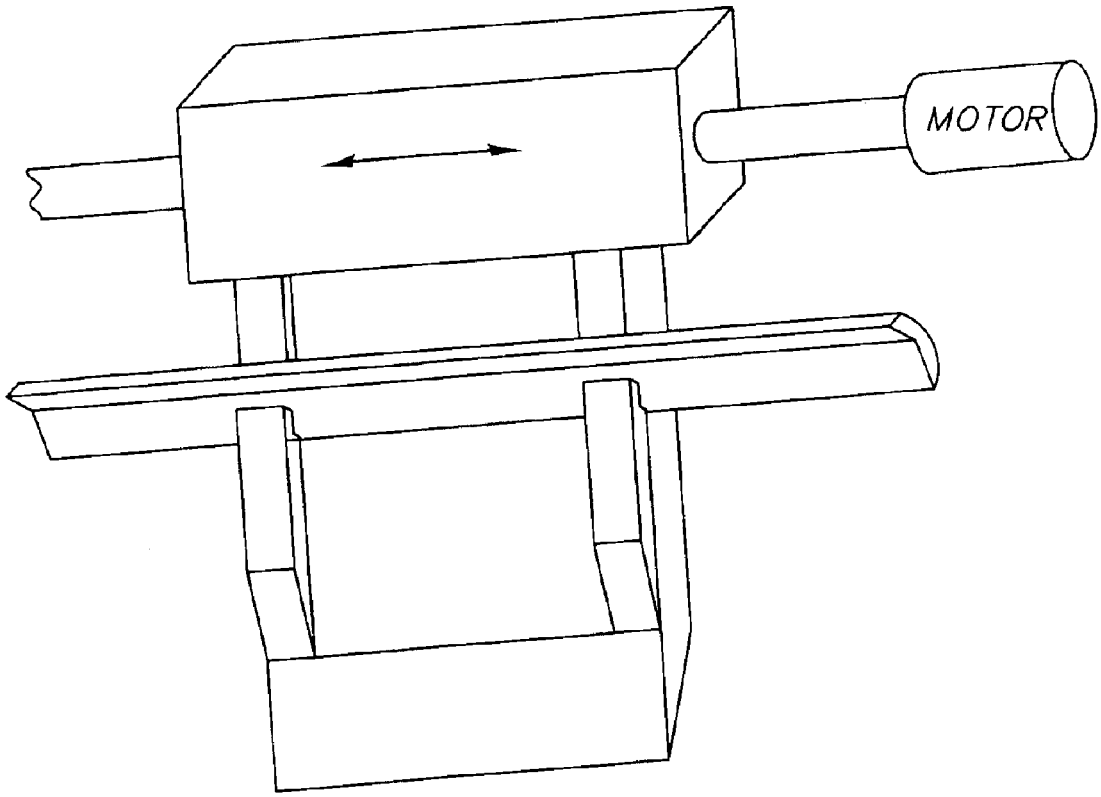
FIG. 2 (PRIOR ART)
FIG. 2 shows a prior art apparatus to improve/correct the shape of the wetting line
Figure 3:
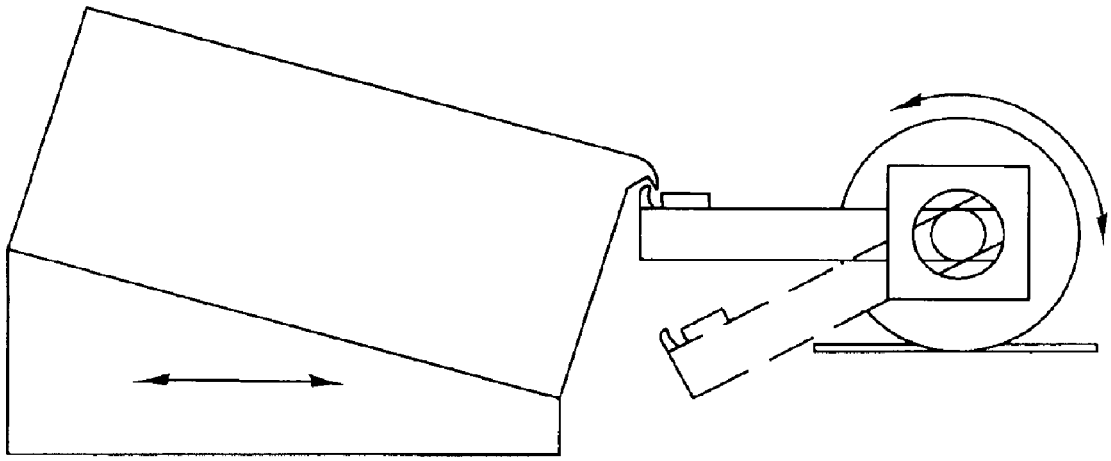
FIG. 3 (PRIOR ART)
FIG. 3 shows another prior art apparatus to correct wetting line shape.
Figure 4:
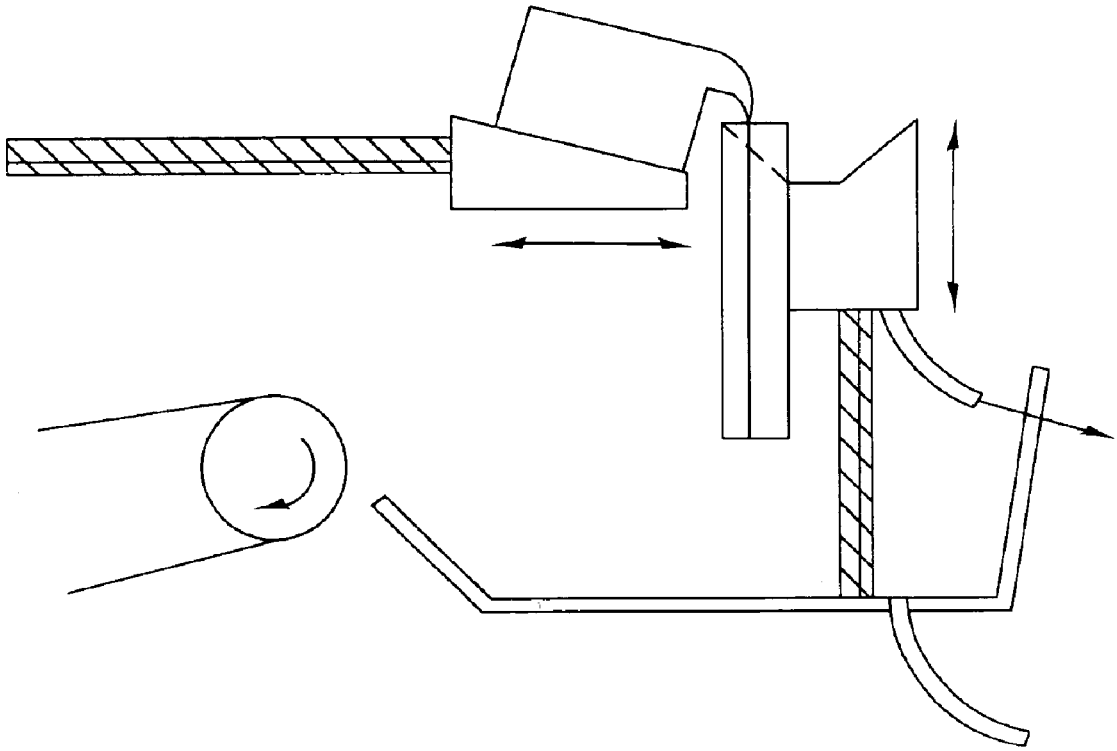
FIG. 4 (PRIOR ART)
FIG. 4 shows a prior art preparation pan for preparation of a coating system to minimize splashing and splattering

The following is a detailed description of the preferred embodiments of the invention, reference being made to the drawings in which the same reference numerals identify the same elements of structure in each of the several figures.

Figure 7:
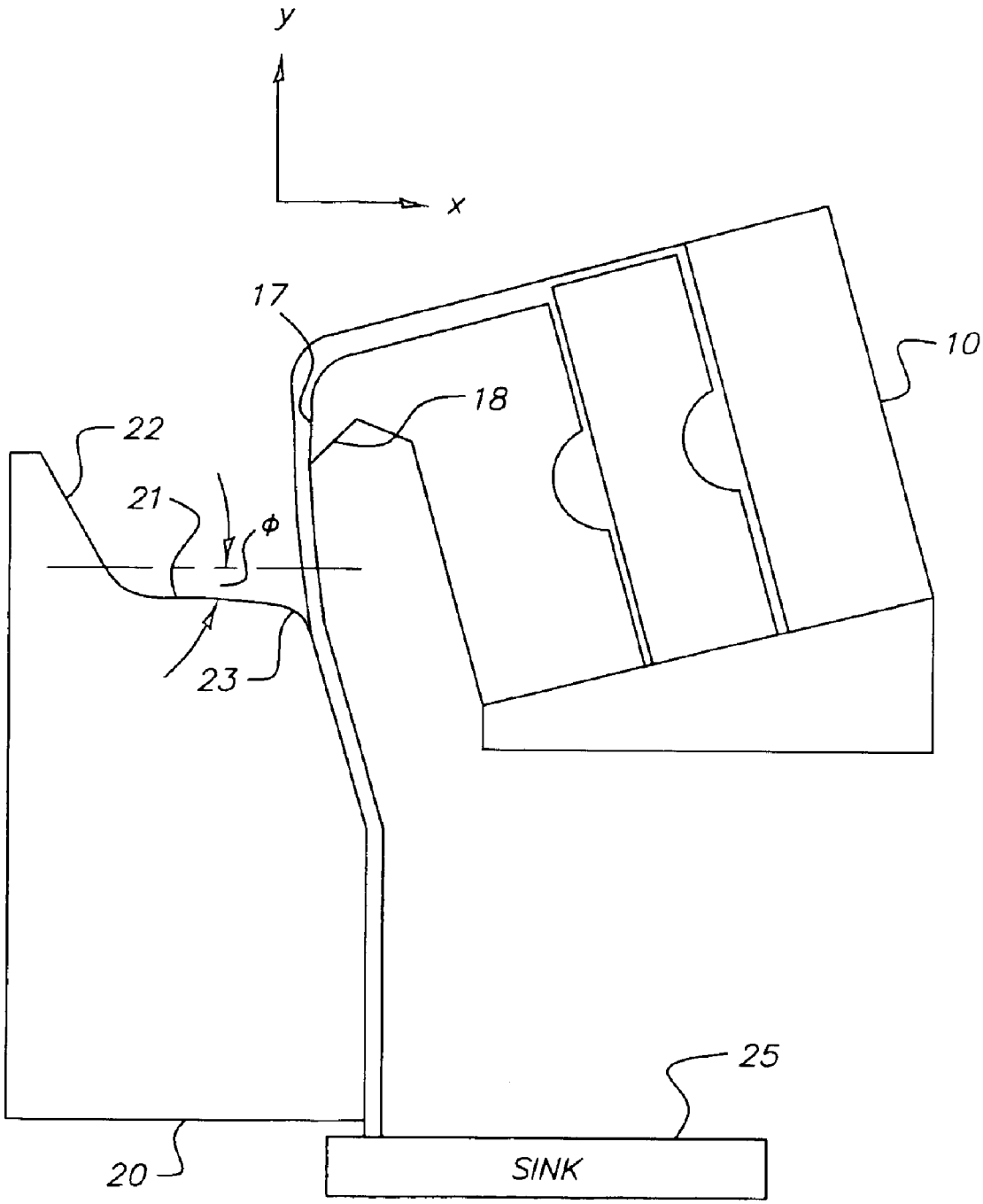
FIG. 7 shows a side cross-sectional view of the preparation ledge of the present invention showing a preferred position of the lip when coating compositions are first brought to the slide die.
Figure 8:
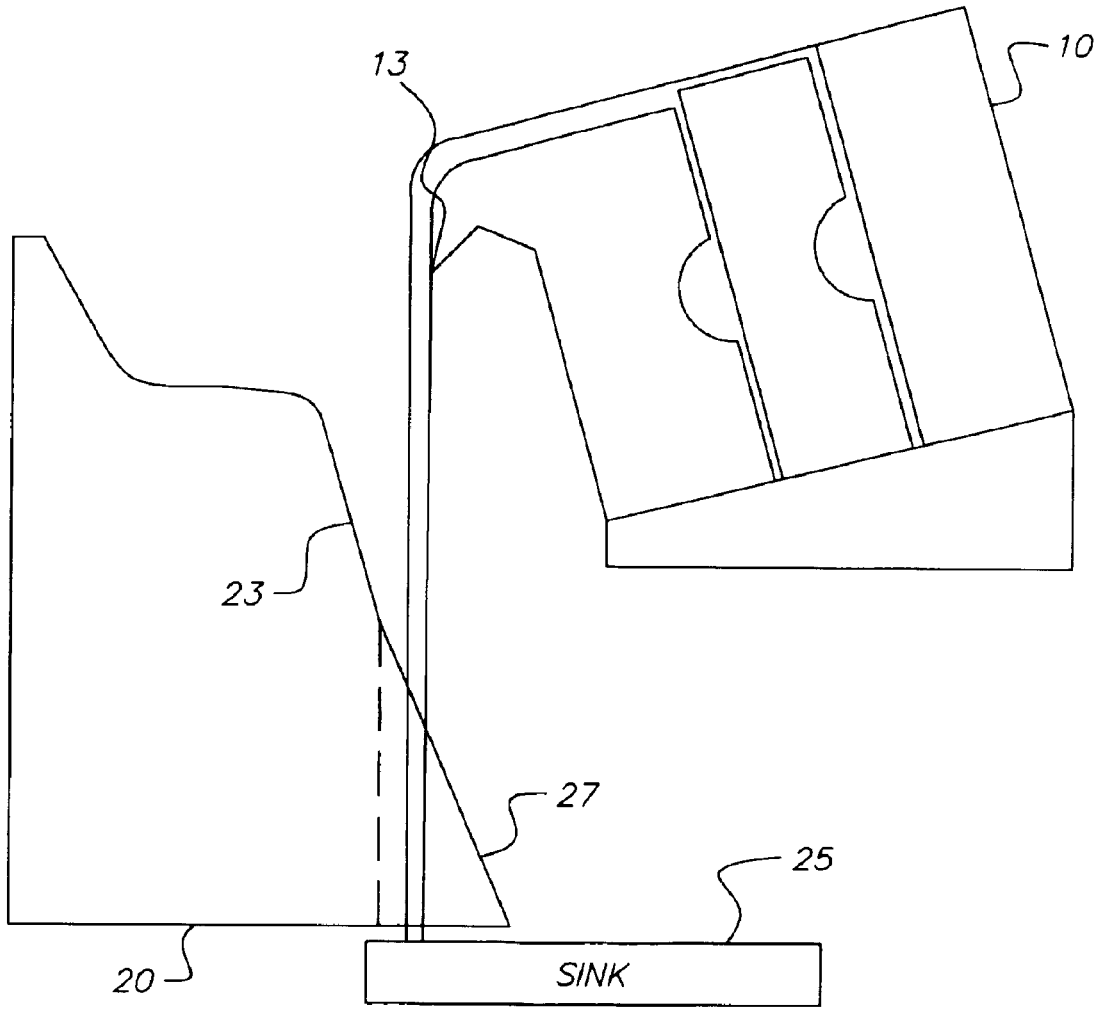
FIG. 8 shows a side view of the preparation ledge of the present invention showing contact between a side plate and the curtain as the ledge and slide die are separated in preparation for coating.
Figure 9:
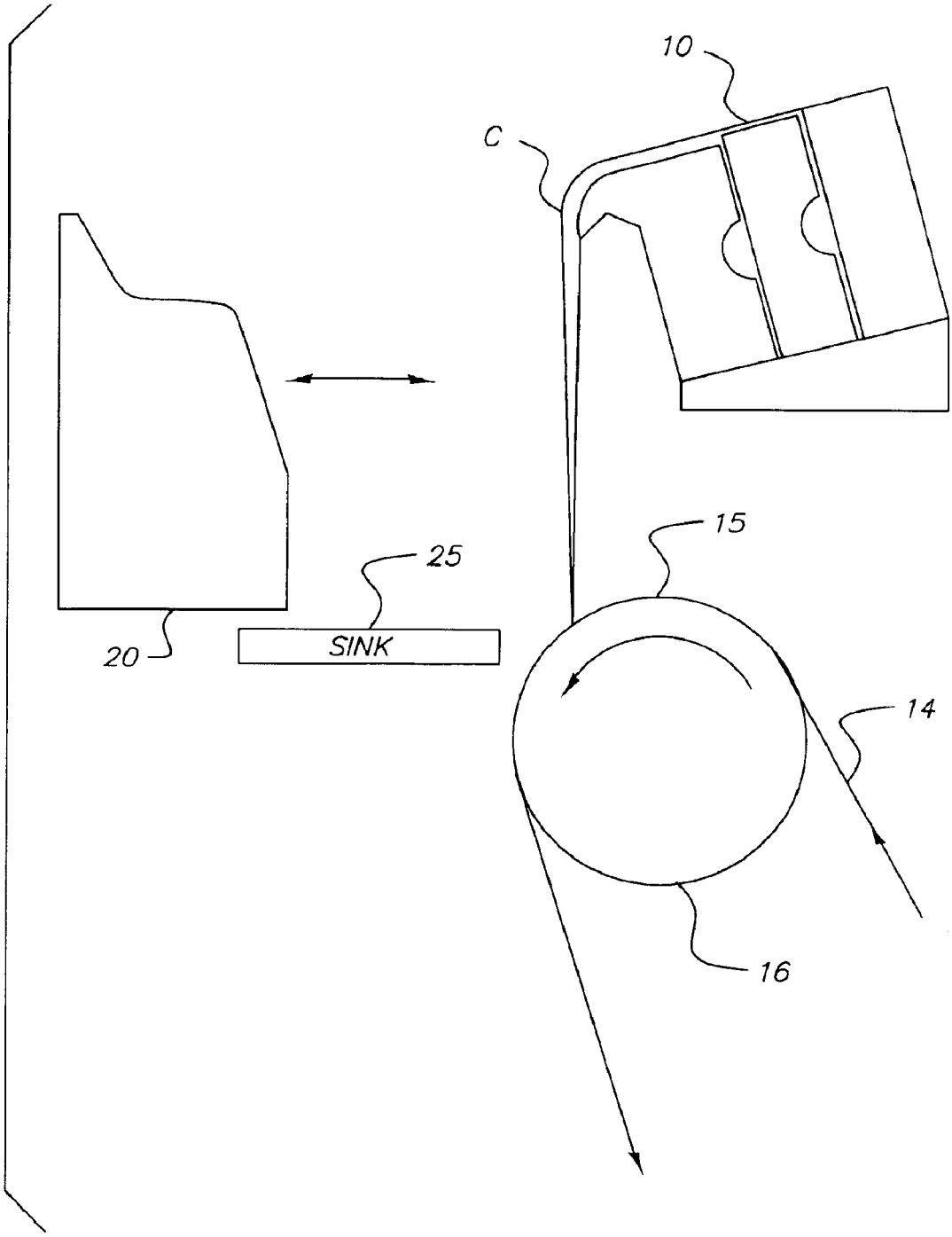
FIG. 9 shows a side view of the preparation ledge of the present invention showing a coating roller, a web receiving surface, and a position of the slide die during coating.

Referring now to FIGS. 5 through 9, there is shown a curtain coating system in accordance with the present invention. The curtain coating system comprises a feeding system from which flows the curtain composition comprising at least one layer. As disclosed above, dies and weirs can be employed to form free-falling liquid curtains. A slide die 10 includes multiple die elements 11 for laterally distributing coating compositions to form a curtain that is a composite of several layers of distinct coating composition. Layers of the coating composition flow from slots onto a slide surface 12 that is downwardly inclined so that the layers flow by gravity. Slide die 10 terminates at a substantially horizontal lip 13. That is, substantially horizontal across the width of the die, wherein the width is referenced as a direction transverse to the direction of the moving support (i.e., coating width). A curtain C of freely falling coating composition extends from lip 13 to a coating-receiving surface 15 over a vertical distance, preferably between about 2 cm and about 30 cm. The coating composition in curtain C accelerates by gravity. Coating-receiving surface 15 can be any surface that can be passed through curtain C such as discrete three-dimensional objects or continuous webs. As best depicted in FIG. 9, in a preferred embodiment, a web 14 with coating-receiving surface 15 is preferably supported through the zone of curtain impingement by a precision backing roller 16.

Lip 13 includes a front surface 17 that is part of slide surface 12, and a back surface 18 that is not part of slide surface 12 and partially wetted. A wetting line 19 disposed on back surface 18 may be irregular in shape as a result of transients in starting the flow of coating composition. Wetting-line irregularities can produce streaks in the coating that must be removed as waste if sufficiently severe. A streak is a widthwise variation in coating uniformity continuing indefinitely and substantially unchanged in the direction of coating. Wetting-line irregularities can also cause stationary waves in the curtain that result in streaks. The coating non-uniformities associated with stationary waves in the curtain become increasingly severe as total flow rate is increased. Therefore, the non-uniformities typically manifest as coating speed is increased or as more layers are coated simultaneously, which are steps frequently taken for improved productivity. Accordingly, there exists a need for determining an effective and practical method/system to prevent wetting-line irregularities.

Figure 5:
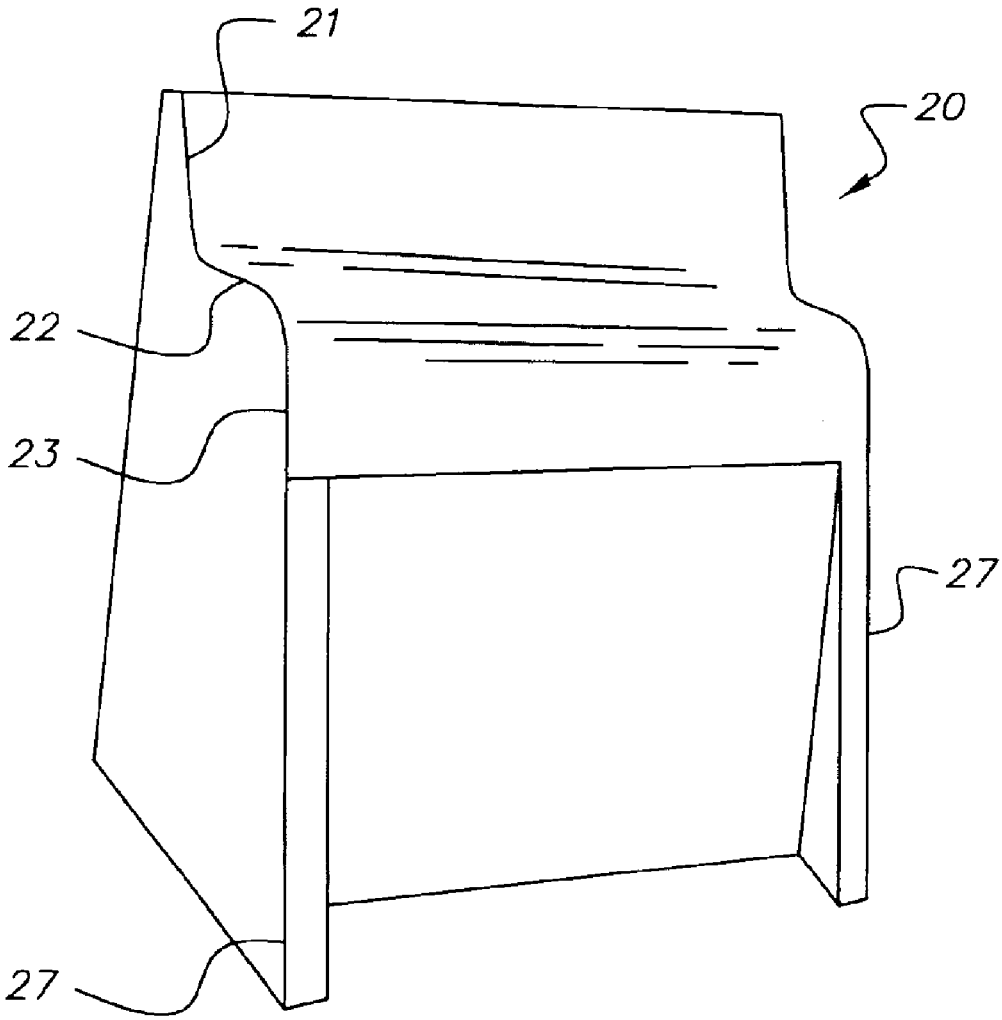
FIG. 5 shows a perspective view of a preparation ledge in accordance with the present invention

Applicant was surprised to recognize that an irregular wetting line can be prevented or straightened by use of a preparation ledge 20, generally depicted in FIG. 5. Ledge 20 is substantially parallel to lip 13 of slide die 10 across the width of the die. Ledge 20 includes a first surface portion 21, a second surface portion 22, and a third surface portion 23, wherein first surface portion 21 is disposed intermediate second surface portion 22 and third surface portion 23. A first surface portion 21 of ledge 20 is substantially horizontal though preferably pitched slightly downward towards slide die 10. That is, ledge 20 is slightly downwardly inclined in the direction toward slide die 10. The pitch/incline of first surface portion 21 of ledge 20 is preferably in the range of about 0° to about 5°, from horizontal, depicted as $\phi$ from the x-axis shown in FIG. 7. Second surface portion 22 is contiguous with first surface portion 21 and is configured to extend upward and away from slide die 10. Third surface portion 23 is contiguous with first surface portion 21 and is configured to be pitched steeply downward. Third surface portion 23 is closer to slide die 10 than second surface portion 22. A pitch of third surface portion 23 is preferably in the range of about 45° to about 90° from horizontal. The transitions between the three surface portions 21, 22, 23 are preferably smooth and rounded rather than distinct edges so to promote flow and drainage.

Figure 6:
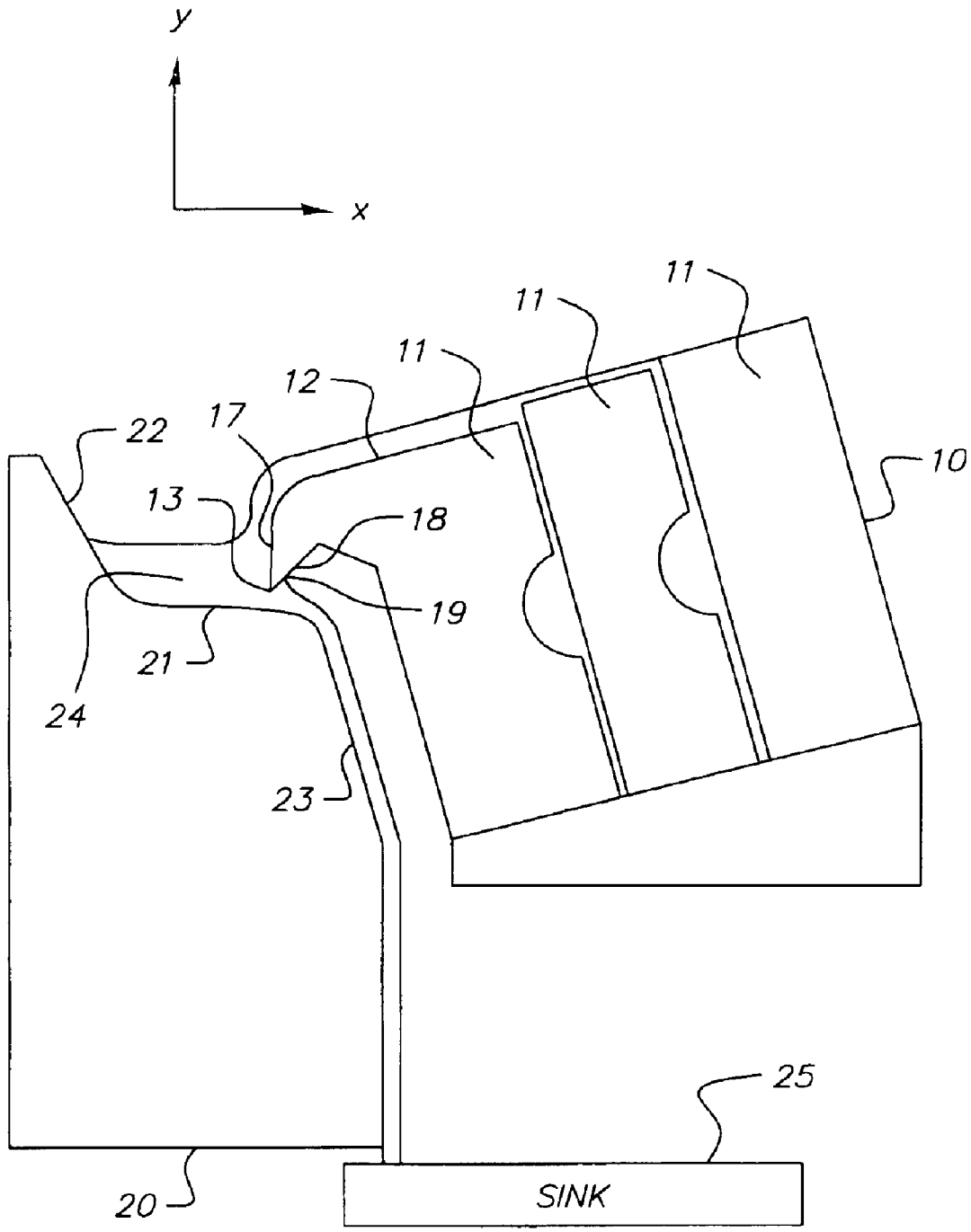
FIG. 6 shows a cross-sectional view of the preparation ledge of FIG. 5 showing the position of the lip for advancing the wetting line beyond its natural position.

Initially, (that is, after the coating compositions have begun flowing from slide die 10 and before the start of a coating on the support), the position of lip 13 is typically disposed just above first surface portion 21 as best shown in FIG. 6. (FIG. 6 shows a cross-sectional view preparation ledge 20 showing the position of lip 13 for advancing the wetting line beyond its natural position.) Such a gap between lip 13 and first surface portion 21 ranges from about 0.5 mm to about 5 mm, and is typically about 2 mm. The coating composition flows from slide die 12 to first surface portion 21 and passes through the gap and onto third surface portion 23. Second surface portion 22 blocks the flow of the coating composition in the other direction. Indeed, slide surface 12, first surface portion 21, and second surface portion 22 form a reservoir 24 that fills partially. As best understood, hydrostatic pressure in reservoir 24 drives the coating composition through the gap and onto third surface portion 23. Because third surface portion 23 is steeply pitched, the coating composition is efficiently removed into a sink means 25 or other collection reservoir. Sink means 25 can include any type of collecting device for the collection of coating composition for disposal or recovery.

A layer of the coating composition disposed on first surface portion 21 adjacent/behind lip 13 is thick because of the substantially horizontal orientation of first surface portion 21. As a result, the coating composition partially wets back surface 18 of lip 13. Surface tension also drives the partial wetting. The height of a wetting line above a tip of lip 13 is preferably between about 1 and a few millimeters. Accordingly, the proximity of lip 13 to preparation ledge 20 causes wetting line 19 to advance upward along back surface 18 beyond its natural position for coating. Wetting line 19 then recedes to its natural position upon the separation of lip 13 and preparation ledge 20 for coating. As disclosed in U.S. Pat. No. 5,725,666 (Baumlin), referenced above, the receding coating composition results in a straight wetting line.

When the coating composition is first delivered to slide die 10, it is advantageous, but not necessary, that the position of lip 13 be such that the third surface portion 23 intercepts the coating composition after a short fall and guides it to sink means 25 as best depicted in FIG. 7. (FIG. 7 shows a side cross-sectional view of preparation ledge 20 showing a preferred position of lip 13 when coating compositions are first brought to slide die 10.) In this configuration, contamination and other problems related to chaotic flow and splashing are reduced/avoided. After satisfactory delivery of the coating composition has been achieved, the relative position of lip 13 and ledge 20 is changed to straighten the wetting line as recited.

Sometimes, when coating is stopped, a solvent for the coating composition or a cleaning solution is delivered to the elements of slide die 10 to remove all the coating composition. For aqueous coating compositions, a suitable solvent is water, and cleaning agents include chemicals such as surfactants, detergents, and bleach. In this situation, it is advantageous for lip 13 to be positioned over first surface portion 21 as shown in FIG. 6 so that the solvent or cleaning solution partially wets back surface 18 of lip 13. Contaminants on back surface 18 of lip 13, including solidified coating composition, can cause wetting line irregularities. Therefore, back surface 18 is preferably clean, and the preparation ledge used together with an effective solvent or cleaning solution helps to soften and/or remove contaminants and prevent further contamination.

Sometimes slide die 10 is substantially empty and dry when the coating compositions are first delivered. In this situation, expensive coating composition is not wasted displacing some other liquid, such as a cleaning liquid, from the die. Delivering coating composition to a dry slide die is known to be more prone to forming wetting line irregularities than to a die initially filled with solvent or cleaning solution. Therefore, the present invention is particularly advantageous for startup from a dry slide die.

Applicant is not aware of any special requirements for the materials of construction of ledge 20, but those skilled in the art will recognize that materials that facilitate maintenance and cleaning can be advantageous. Alternatively, coatings or release agents can be applied to the surfaces of ledge 20 to facilitate maintenance and cleaning. A flushing liquid, such as a solvent or cleaning solution, can be delivered to the surfaces of ledge 20 after use to clean them. Such flushing liquid may, for example, be delivered to second surface portion 22 through a slit, holes, or the like from a distribution cavity within the body of ledge 20. The flushing liquid would subsequently flow over the first and third surface portions of ledge 20 and into sink means 25 by gravity.

Various methods and means can be employed for positioning slide die 10 and preparation ledge 20. A particularly advantageous method is to employ the positioning means for the slide die and to maintain the preparation ledge stationary. In most installations, the slide die moves by a precision linear positioning device, such as a linear motor. Therefore, it is efficient to stationarily position ledge 20 and use an existing positioning means to position lip 13 with respect to ledge 20. However, it is recognized that ledge 20 can be moved if desired. It is noted that the manner in which the relative position of lip 13 and preparation ledge 20 is achieved is not believed to be critical to the function.

Curtain C may not form along the edge guides when slide die 10 and preparation ledge 20 are separated in preparation for coating. More particularly, when the curtain is not in contact with the edge guides, the curtain narrows as it falls due to surface tension. Curtain formation along the edge guides depends upon many factors including the effectiveness of the particular edge guides in use, the flow rate of coating composition, and the value of surface tension. Although an operator can draw the curtain down the edge guides by one of several manual methods, automatic attachment of the curtain to the edge guides is preferable. Surprisingly, two side plates 27 of preparation ledge 20 can attach the curtain to the edge guides as the preparation ledge and slide die separate, as best shown in FIG. 8. These side plates need only be of a sufficient thickness for mechanical stability. Applicant has determined that a thickness in the range from about 1 millimeter to several millimeters is effective. In a preferred embodiment, side plates 27 extend beyond third surface portion 23 toward slide die 10 by a projecting length that gradually increases as elevation decreases. The projecting length is small or negligible where first 21 and third 23 surface portions meet and increases at the rate of about 1 centimeter for every 10 centimeters of vertical drop. A linear increase is effective, but Applicant notes that other continuously increasing profiles can also be effective. Side plates 27 preferably project far enough that the curtain remains in contact with them after it detaches from third surface portion 23 of preparation ledge 20. Thereafter, side plates 27 maintain curtain width and gradually transfer the curtain to the edge guides as the ledge and slide die separate, as depicted in FIG. 8. The distance between the side plates and edge guides is a few millimeters. Preferably, the side plates extend along the entire length of the edge guides to ensure the attachment of the curtain, but depending upon many factors, the curtain may form even if the side plates extend downward some lesser distance.

Flushing the preparation ledge with a solvent or cleaning liquid after use is not essential but can be advantageous for cleanliness. The flushing liquid can be introduced onto second surface portion 22 and flow by gravity along the second, first, and third surface portions to sink means 25. Smoothing the transitions between first 21 and second 22 surface portions and first 21 and third 23 surface portions also promotes cleanliness by facilitating the drainage of liquids.

Coating width may change to accommodate different products. Attaching extensions with the same cross section can increase the width of the preparation ledge. Replacing the ledge with one of different width is another option because the cost of a ledge is modest. Various methods of attachment that allow precise and rapid replacement are known.

Accordingly, the present invention is generally directed to providing a ledge that is substantially parallel to the lip across the width of the die. The ledge has a first surface portion that is substantially horizontal. The ledge has a second surface portion contiguous with the first surface portion that is inclined upwardly and away from the slide die to block flow. The ledge also has a third surface portion contiguous with the first surface portion that is closer to the slide die than the second surface portion and that is downwardly inclined to remove coating composition by gravity. When coating composition is first brought to the slide die, it preferentially falls from the lip a short distance onto the third surface portion that conducts it to a sink. Just prior to the commencement of coating, the position of the lip is slightly above the first surface portion. Because the first surface portion is substantially horizontal and the second surface portion blocks flow, a thick layer of liquid is formed that wets the back surface of the lip beyond the normal position of the wetting line. The ledge has side plates projecting toward the slide die that draw the curtain down the edge guides as the ledge and slide die are separated for the commencement of coating. The ledge can as well be advantageously used when cleaning solution is delivered to the slide die. In that case the position of the lip is slightly above the first surface portion for an extended period of time so that cleaning solution wets the back surface of the lip beyond the normal position of the wetting line.

Those skilled in the art will recognize that performance can be optimized for specific applications by varying the position of the lip relative to the ledge. Optimization is a matter of experience and can be accomplished by routine experimentation.

Examples are now provided to more particularly describe the invention.

EXAMPLE 1

Figure 10:
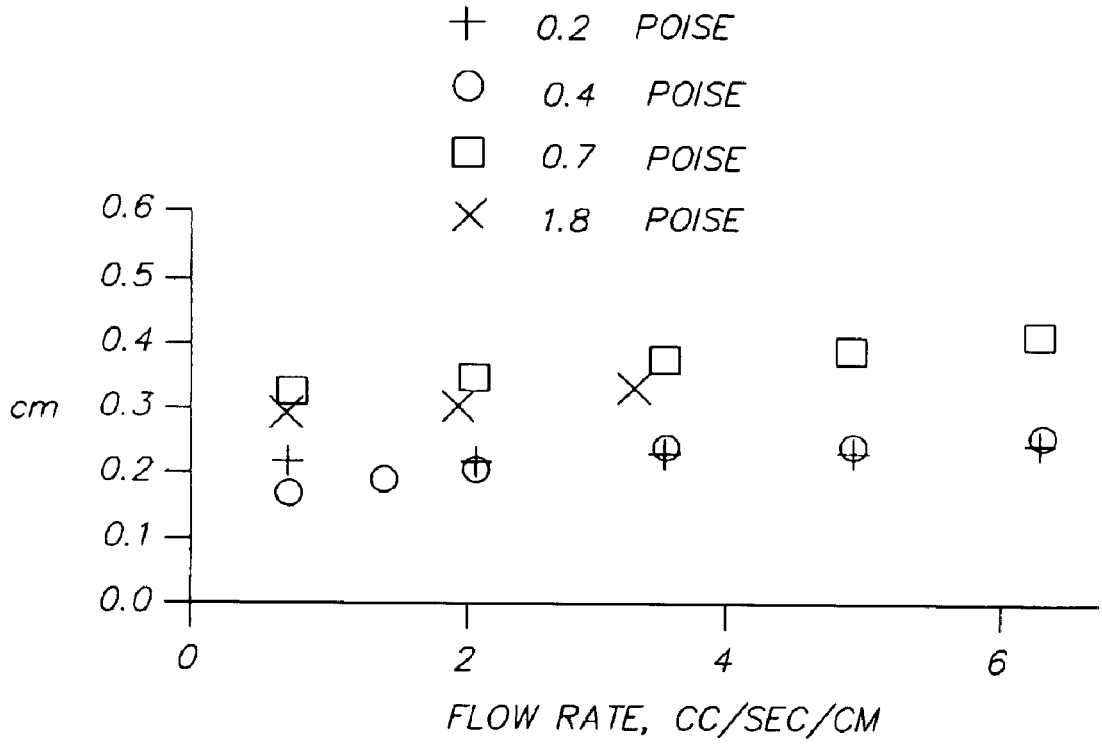
FIG. 10 shows a plot of measurements of the height of the wetting line above the tip of the lip for various flow rates and viscosities.

Measurements were made of the vertical height of the wetting line above the tip of the lip using a long-range microscope mounted to a precision positioning table. Test liquids of aqueous hydroxyethyl cellulose polymer with surfactant were prepared at viscosities of 0.2, 0.4, 0.7 and 1.8 poise. Measurements were made over a broad range of flow rates. For the ledge, the first surface portion had an inclination of 2°, the second surface portion had an inclination of 45°, the third surface portion had an inclination of 75°, and the transition between the first and third surface portions had a radius of 3 mm. The lip was positioned 2 mm above the first surface portion just beyond the transition. FIG. 10 shows a plot of measurements of the height of the wetting line above the tip of the lip for various flow rates and viscosities. More particularly, FIG. 10 shows a plot of the measurements showing how the wetting line advances above the tip of the lip by 0.2–0.4 cm, a distance exceeding its equilibrium position of no more than about 1 mm. The advance is somewhat greater the higher the flow rate and the higher the viscosity, but one gap is suitable for a broad range of conditions.

EXAMPLE 2

A curtain was formed using a five-element slide die. For the ledge, the first surface portion had an inclination of 2°; the second surface portion had an inclination of 45°; the third surface portion had an initial inclination of 75° for 3 cm and a final inclination of 90°; the transition between the first and second surface portions had a radius of 3 mm; and the transition between the first and third surface portions had a radius of 3 mm. The coating composition was aqueous gelatin with viscosity 0.4 poise. The coating composition delivered to the lowermost element of the slide die had a flow rate of 0.30 cc/sec per cm of curtain width; this coating composition contained surfactant and a slurry of carbon black to provide optical density in the curtain. The coating composition delivered to the adjacent two elements of the die had a flow rate of 1.07 cc/sec per cm of width. The coating composition delivered to the uppermost two elements of the die had a flow rate of 1.07 cc/sec per cm of width and contained surfactant. The total flow rate in the curtain was therefore 2.44 cc/s per cm of width. The coating composition from the lowermost element of the slide die wets the back surface of the lip, and so confining the carbon slurry to that portion of the coating composition accentuates the streaks from wetting-line irregularities.

An optical densitometer mounted to a motor-driven positioning slide was used to measure the optical density of the curtain across 81 cm of the total curtain width of 135 cm. A measurement of optical density was acquired every 0.08 cm. The optical density measurement is related to the thickness of the layer of coating composition containing the carbon slurry through Beer's law of light absorption. A streak caused by an irregular wetting line is of the order of a centimeter in width, and the longer variations in layer thickness caused by mechanical tolerances of the die element are unrelated to wetting-line shape. Time-dependent variations in layer thickness also occur as a result of slightly unsteady flow. Sources of unsteadiness include pumps, mechanical vibrations of the slide die, and unsteady ambient airflow. The data were averaged to reduce the variations in optical density unrelated to wetting-line streaks. A moving average of a density trace was computed from data covering 1.27 cm (17 consecutive measurement points). This averaged data was subtracted from the original data and the root-mean-square (rms) was computed to obtain an estimate of the amplitude of the streaks from wetting-line irregularities. After formation of the curtain, the average rms value was 0.213% with a standard deviation of 0.047%. After straightening the wetting line, the average rms value was 0.130% with a standard deviation of 0.017%, and this value indicated a streak-free condition. The two optical density traces taken for each condition gave nearly the same values.

Wetting-line irregularities also cause slight deformations of the surfaces of the curtain that experienced observers can see in reflected light of low-incidence. This subjective method was used to verify the effectiveness of the ledge at eliminating wetting-line irregularities. The subjective and quantitative methods gave consistent results.

In one test, water was delivered to the die elements prior to introducing the coating composition as recited above. With the lip in position over the first surface portion and gapped at 0.15 cm, coating composition was brought first to the lowermost element and then to the upper elements in order. This sequence was used because it is more likely to lead to wetting-line irregularities than the reverse sequence. After the trough and die were separated, an rms value of 0.13% corresponding to a straight wetting line was obtained.

In another test, coating composition was delivered to a die that had been drained. With the lip in position over the first surface portion and gapped at 0.08 cm, coating composition was initially delivered to the lowermost die element and then to the remaining die elements in order. After the trough and die were separated, an rms value of 0.12 corresponding to a straight wetting line was obtained. Similarly, a value of 0.13 was obtained for a gap of 0.23 cm.

In other tests, coating composition was brought to the die with the lip above the third surface portion. In some of these tests, coating composition containing the carbon slurry was delivered to the lowermost element of the die for a period of five minutes before coating composition was delivered to the remaining elements in order. The flow rate from the bottom element is insufficient to form a curtain; instead the coating composition falls from the lip as regularly spaced streamers that promote an irregular wetting line. In other cases, there was no delay in delivering coating composition to remaining elements. With all coating composition flowing, the ledge and slide die were separated for enough time to obtain optical density traces. The lip and first surface portion were then positioned to straighten the wetting line. Upon separation of the ledge and slide die, optical density traces were again obtained. So, the rms value was determined before and after the action of the ledge. In a test with a five-minute delay and a gap of 0.23 cm, rms values of 0.24 and 0.13 were obtained before and after the wetting line was straightened, respectively. In another test with a five-minute delay and a gap of 0.30 cm, values of 0.29 and 0.13 were obtained. In tests without a delay, values of 0.18 and 0.13 were obtained at a gap of 0.15 cm and values of 0.20 and 0.13 at a gap of 0.23 cm.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

| | |
|---|---|
| 2, 3 | slots |
| 4 | inclined flow surface |
| 5 | lip |
| 6 | front surface |
| 10 | slide die |
| 11 | die element |
| 12 | slide surface |
| 13 | lip |
| 14 | web |
| 15 | coating-receiving surface |
| 16 | backing roller |
| 17 | front surface of lip |
| 18 | back surface of lip |
| 19 | wetting line |
| 20 | preparation ledge |
| 21 | first surface portion |
| 22 | second surface portion |
| 23 | third surface portion |
| 24 | reservoir |
| 25 | sink means |
| 27 | side plates |

What is claimed is:

1. A method for improving the uniformity of a liquid curtain in a coating system comprising a lip of a slide die wherein the lip includes a front surface on which a liquid composition flows by gravity, the method comprising the steps of:

providing a ledge having a first, second, and third surface portion wherein the first surface portion is disposed intermediate the second and third surface portions, the first surface portion being substantially horizontal, the second surface portion being contiguous with the first surface portion and upwardly inclined away from the first surface portion, the third surface portion being contiguous with the first surface portion and downwardly inclined away from the first and second surface portions;

supplying the liquid composition to the slide die; and positioning the ledge and lip relative to each other in a first orientation wherein the lip is disposed proximate the first surface portion whereby the liquid composition flows from the slide die onto the first surface portion, through a gap disposed between the lip and the first surface portion such that the liquid composition partially wets the back surface of the lip, and onto the third surface portion.

2. The method of claim 1, wherein the step of positioning is accomplished by moving the slide die while the ledge remains stationary.

3. The method of claim 1, wherein the step of positioning is accomplished by forming the gap of between about 0.5 mm to about 5 mm from the first surface portion when in the first orientation.

4. The method of claim 1, further comprising the step of positioning the ledge and slide die in a second orientation wherein the lip and the ledge are spaced from each other whereby the liquid composition forms a vertical liquid curtain in free fall.

5. The method of claim 1, further comprising the step of flushing at least the first surface portion with a miscible liquid.

6. The method of claim 1, further comprising the step of, prior to positioning the ledge and lip relative to each other, positioning the lip proximate the third surface portion as the liquid composition is supplied to the slide die.

7. The method of claim 7, wherein the lip is positioned vertically above the third surface portion as the liquid composition is supplied to the slide die.

8. A method for improving the uniformity of a liquid curtain in a coating system comprising a lip of a slide die wherein the lip includes a front surface on which a liquid composition flows by gravity, the method comprising the steps of:

providing a ledge having a first, second, and third surface portion wherein the first surface portion is disposed intermediate the second and third surface portions, the first surface portion being substantially horizontal, the second surface portion being contiguous with the first surface portion and upwardly inclined, the third surface portion being contiguous with the first surface portion and downwardly inclined away from the first and second surface portions;

supplying the liquid composition to the slide die;

positioning the ledge and lip relative to each other in a first orientation wherein the lip is disposed proximate the first surface portion whereby the liquid composition flows from the slide die onto the first surface portion such that the liquid composition partially wets the back surface of the lip; and prior to positioning the ledge and lip relative to each other, positioning the lip proximate the third surface portion as the liquid composition is supplied to the slide die.

9. The method of claim 8, further comprising the step of flushing at least the first surface portion with a miscible liquid.

10. The method of claim 8, wherein the lip is positioned vertically above the third surface portion as the liquid composition is supplied to the slide die.

11. An apparatus for improving the uniformity of a liquid curtain in a coating system comprising a lip of a slide die wherein the lip includes a front surface on which a liquid composition flows by gravity, comprising:

a ledge having a first, second, and third surface portion wherein the first surface portion is disposed intermediate the second and third surface portions, the first surface portion being substantially horizontal, the second surface portion being contiguous with the first surface portion and upwardly inclined away from the first surface portion, the third surface portion being contiguous with the first surface portion and downwardly inclined away from the first and second surface portions; and positioning means for positioning the ledge and lip relative to each other (1) in a first orientation wherein the lip is disposed proximate the first surface portion whereby the liquid composition flows from the front surface of the lip onto the first surface portion, through a gap between the lip and the first surface portion such that the liquid composition partially wets the back surface of the lip, and onto the third surface portion, and (2) in a second orientation wherein the lip and the ledge are spaced from each other whereby the liquid composition forms a vertical liquid curtain in free fall.

12. The apparatus of claim 11, wherein the ledge further comprises at least one side plate disposed on the third surface portion and extending toward the slide die by a projecting length that gradually increases as elevation decreases.

13. The apparatus of claim 12, wherein the projecting length of the side plate increases at the rate of about 1 centimeter for every 10 centimeters of vertical drop.

14. The apparatus of claim 11, wherein the ledge is stationary, and the positioning means is configured to position the slide die relative to the ledge.

15. The apparatus of claim 11, wherein the slide die is stationary, and the positioning means is configured to position the ledge relative to the slide die.

16. The apparatus of claim 11, wherein the gap is between about 0.5 mm to about 5 mm when in the first orientation.

17. The apparatus of claim 11, further comprising sink means for receiving the liquid composition from the ledge.

18. The apparatus of claim 11, further comprising flushing means for delivering a flushing liquid to at least the first surface portion of the ledge.

19. The apparatus of claim 11, wherein at least the first surface portion of the ledge comprises a release coating applied to the first surface portion.

20. The apparatus of claim 11, wherein the first surface portion is downwardly inclined in the direction toward the slide die from about 0 degrees to about 5 degrees from horizontal.

21. An apparatus for improving the uniformity of a liquid curtain in a coating system comprising a lip of a slide die wherein the lip includes a front surface on which a liquid composition flows by gravity, comprising:

a ledge having a first, second, and third surface portion wherein the first surface portion is disposed intermediate the second and third surface portions, the first surface portion being substantially horizontal, the second surface portion being contiguous with the first surface portion and upwardly inclined, the third surface portion being contiguous with the first surface portion and downwardly inclined away from the first and second surface portions, the ledge comprising at least one side plate disposed on the third surface portion and extending toward the slide die by a projecting length that gradually increases as elevation decreases; and positioning means for positioning the ledge and lip relative to each other (1) in a first orientation wherein the lip is disposed proximate the first surface portion whereby the liquid composition flows from the slide die onto the first surface portion such that the liquid composition partially wets the back surface of the lip, and (2) in a second orientation wherein the lip and the ledge are spaced from each other whereby the liquid composition forms a vertical liquid curtain in free fall.

22. The apparatus of claim 21, wherein the projecting length of the side plate increases at the rate of about 1 centimeter for every 10 centimeters of vertical drop.

23. An apparatus for improving the uniformity of a liquid curtain in a coating system comprising a lip of a slide die wherein the lip includes a front surface on which a liquid composition flows by gravity, comprising:

a ledge having a first, second, and third surface portion wherein the first surface portion is disposed intermediate the second and third surface portions, the first surface portion being substantially horizontal, the second surface portion being contiguous with the first surface portion and upwardly inclined, the third surface portion being contiguous with the first surface portion and downwardly inclined away from the first and second surface portions;

positioning means for positioning the ledge and lip relative to each other (1) in a first orientation wherein the lip is disposed proximate the first surface portion whereby the liquid composition flows from the slide die onto the first surface portion such that the liquid composition partially wets the back surface of the lip, and (2) in a second orientation wherein the lip and the ledge are spaced from each other whereby the liquid composition forms a vertical liquid curtain in free fall; and flushing means for delivering a flushing liquid to at least the first surface portion of the ledge.

* * * * *